United States Patent [19]

Safian et al.

[11] 4,250,726

[45] Feb. 17, 1981

[54] SHEET ROLLING METHOD

[76] Inventors: Matvei M. Safian, ulitsa Pisarzhevskogo, 3, kv. 2, Dnepropetrovsk; Eduard A. Babich, prospekt Metallurgov, 71a, kv. 49; Boris S. Dolzhenkov, ulitsa Aerodromnaya, 87, kv. 2, both of Kuibyshev; Valery D. Esaulenko, ulitsa Platona, 12, kv. 1, Dnepropetrovsk, all of U.S.S.R.

[21] Appl. No.: 937,074

[22] Filed: Aug. 28, 1978

[51] Int. Cl.[3] ..... B21B 9/00; B21B 45/02; B21B 45/06

[52] U.S. Cl. ..... 72/38; 72/40; 72/53

[58] Field of Search ..... 72/38, 39, 40, 42, 53, 72/201, 236; 29/81 C, 81 K; 134/9, 15

[56] References Cited

U.S. PATENT DOCUMENTS

| | | | |
|---|---|---|---|
| 1,560,749 | 11/1925 | Witherow | 72/39 |
| 2,197,022 | 4/1940 | Petterson | 72/40 X |
| 3,019,522 | 2/1962 | Bluth et al. | 72/53 |
| 3,138,845 | 6/1964 | Hellman et al. | 72/53 |
| 3,766,763 | 10/1973 | Cofer et al. | 72/201 X |
| 3,811,305 | 5/1974 | Saylor | 72/39 |
| 4,043,166 | 8/1977 | Leroy | 72/39 |

FOREIGN PATENT DOCUMENTS

| | | | |
|---|---|---|---|
| 51-5821 | 2/1976 | Japan | 72/39 |
| 153905 | 3/1962 | U.S.S.R. | 72/42 |
| 439383 | 4/1975 | U.S.S.R. | 72/53 |

*Primary Examiner*—Ervin M. Combs

*Attorney, Agent, or Firm*—Steinberg & Raskin

[57] ABSTRACT

According to the invention, both sides of a sheet metal billet are worked with solid hard spherical microbodies prior to each reverse rolling operation. Microbodies are fed by means of a gas jet and have a diameter of 40 to 200 microns. They are of a material selected from the group consisting of glass, aluminum oxide, zirconium oxide, chrome-nickel alloys, and ice. The rolling produces a mirror or dull finish, an effect normally attained by etching, grinding or polishing.

7 Claims, No Drawings

SHEET ROLLING METHOD

BACKGROUND OF THE INVENTION

1. Field of the Application

The present invention relates to the rolling of sheet metal billets and, more particularly, to methods for manufacturing sheet products of aluminum alloys, stainless steel and other metals with a mirror or dull surface finish.

2. Description of the Prior Art

There are widely known methods for manufacturing rolled sheet products, whereby a sheet billet is worked on both sides to produce a mirror or dull finish. The working is normally carried out by directing a jet of a bulk material at the surface of a sheet metal billet and is followed by chemical treatment and rolling. For example, a sheet metal billet is transferred from a hot-rolling mill to a shot blast machine where the surface of the billet is exposed to a blast of metal shot with particle sizes of 2 to 5 mm. The shot includes sharp-edged particles which partially remove the scale from the billet surface. The billet is then subjected to chemical treatment in alkaline baths and washed, whereupon it is etched in acid baths, again washed and dried. The billet thus treated is sent to a rolling mill.

The rolling is done in a single pass or in a number of passes, in which case each pass is followed by heat treatment of the billet and a removal of scale from its surface. For this purpose, the billet undergoes the above-mentioned operations of shot blasting, chemical treatment in alkaline and acid baths, washing and drying. At the final pass the billet is passivated in nitric acid solution. The cold-rolled product is then worked on a temper mill and cut into sheets. Each sheet is worked on grinding and polishing machines.

As a result, rolled sheets of stainless steel are given a mirror finish.

The application of the above method involves heavy expenses, keeping in mind that it requires much floorspace for auxiliary equipment and considerable amounts of chemical reagents and water. In addition, the process takes much time and demands skilled personnel who have to work in contact with aggressive media. The method under review is further disadvantageous in that the etching of sheet metal billets in acid solutions causes point corrosion which cannot be eliminated by subsequent treatment. Underetching or overetching of the surface of cold-rolled band is another cause of surface defects. However, the most serious disadvantage of the method lies in the necessity of repeatedly performing slow and laborious grinding and polishing operations with the use of special-purpose machines, which operations are in many cases ineffective because of surface flaws brought about by multiple etching operations.

There is commonly known a method for manufacturing bright lustre sheet of aluminum alloys, which is normally used for facing purposes. The method is carried out on cold-rolling mills with the use of oil. The sheet quality largely depends on the quality of the original hot-rolled band, which is the reason why the method does not necessarily yield good results. Besides, the use of pure oil is always fraught with fire hazards, which accounts for the fact that the cost of the fire extinguishing means may be as high as 15 percent of the cost of the entire cold-rolling mill, although even highly sophisticated fire prevention means cannot always preclude a blaze. The use of coolants of the oil-in-water type reduces fire hazards to a minimum, but tends to increase the amount of rejects.

The latter method for manufacturing aluminum alloy sheet does not make it possible to produce cold-rolled sheet with a dull surface onto which a paint coating could subsequently be applied. A dull surface is normally produced on a finished article. As a rule, such operations are carried out at metal-working facilities through the use of various techniques, including the working of articles with microspheres. A microsphere is to be understood as a solid hard spherical body of a diameter measured in microns. The use of microspheres calls for appropriate machinery which, in turn, requires some floorspace and personnel.

The known methods for producing bright lustre sheet necessitate the use of acids and alkalis for cleaning the surfaces of billets and thus can lead to air and water pollution.

The growing production of rolled sheet articles calls for a rolling method which would be more economical and less hazardous from the viewpoint of pollution than the existing methods. Such a method must also ensure the production of sheet products with polished surfaces on the cold-rolling mills. Finally, such a method must ensure a higher productivity and be carried out in such a way as to make the quality of finished products less dependent upon the surface quality of original hot-rolled billets.

SUMMARY OF THE INVENTION

It is the main object of the present invention to provide a method for manufacturing sheet rolled products, which would dispense with the operations of and equipment for etching, grinding and polishing rolled articles, and thus would be more economical than any existing method used for the same purpose.

It is an equally important object of the invention to simplify the process of manufacturing sheet rolled products by reducing the number of operations involved in producing a mirror or dull finish on rolled articles of stainless steel and aluminum alloys.

It is another important object of the invention to improve the quality of rolled products of aluminum alloys and cut down the rejects of processes carried out with the use of oil-in-water type coolants, as well as make the quality of a rolled product less dependent upon that of the billets.

It is a further object of the invention to make it possible to manufacture rolled products with a mirror and dull finish on one rolling mill and thus reduce the floorspace required for the equipment.

It is an associated object of the invention to improve the mechanical properties of certain grades of steel, while attaining the foremost object of the invention.

The foregoing objects are attained by providing a method for manufacturing sheet rolled products, whereby both sides of a sheet metal billet are worked with a jet of a bulk material, whereupon the billet is rolled on a rolling mill, the bulk material consisting of solid hard spherical bodies 40 to 200 microns in diameter, which are supplied with a jet of gas prior to each reverse rolling operation.

According to the invention, the use of solid hard spherical bodies, referred to as microspheres, provides for a more effective removal of scale from the surfaces of rolled sheet products than the use of shot in accordance with conventional methods. Furthermore, microspheres help to eliminate mechanical defects, such as scratches.

The method of this invention provides for an optimum distribution of coolant over the microrelief produced on the billet surface. The above-mentioned grain size of the solid hard spherical bodies provides for such a degree of microroughness on the billet surface that subsequent rolling alone is enough to produce a mirror finish.

The supply of solid hard spherical bodies with a jet of gas is the most convenient technically and makes it possible to work both sides of a sheet metal billet prior to each reverse rolling operation.

It is expedient that use should be made of solid hard spherical bodies of such materials as glass, aluminum oxide, zirconium oxide, chrome-nickel alloys, and ice.

Unlike most materials commonly used for cleaning the surfaces of billets, the above-mentioned materials do not scratch the surfaces they act upon. Microspheres of glass provide for a sufficiently high surface quality of rolled sheet products.

Hard spherical bodies of aluminum oxide, zirconium oxide and chrome-nickel alloys feature a high mechanical strength; microspheres of ice do not require any recovery processes.

Solid hard spherical bodies of different chemical compositions may be used together or in succession.

Simultaneous utilization of solid hard spherical bodies of different materials makes it possible to produce a bulk mixture of prescribed mechanical properties with due regard for the overall cost of the mixture. In the case of successive use of microspheres of different materials, the hardest, such as those of chrome-nickel alloys, or cheapest, such as those of aluminum oxide or ice, are used first to be followed by microbodies of glass during the second stage of the working. Preferably, the weight concentration of solid hard spherical bodies, which is the weight of the bodies to the weight of the carrier, directed at the surface of a rolled sheet billet should be 0.05 to 0.5.

Such an amount of solid hard spherical bodies is enough for effective working of billets produced from metals of different degrees of hardness. The lower limit of the weight concentration coefficient is good enough for aluminum alloys, whereas the upper limit is intended for working billets of stainless steel.

It is desirable that solid hard spherical bodies should be directed at the surface of a sheet metal billet at a speed of 20 to 300 m/sec.

The speed range is determined by the surface quality of the billet, the adhesion of the scale to the metal and the presence of mechanical defects on the billet surface. Speeds close to the lower limit of the foregoing speed range are intended for working billets of aluminum alloys. The upper speed level is meant for billets of stainless steel having serious surface defects.

The action of solid hard spherical bodies on the billet surface may be of the intermittent type. The intermittent supply of microspheres is the most effective way of cleaning billets with serious surface defects and strong scale adhesion.

It is advisable that a jet of solid hard spherical bodies should be directed at the surface of a billet before the latter reaches at least the second stand of the rolling mill.

This makes it possible to produce a mirror finish on rolled sheets of stainless steel. The billet surface quality is successively improved, as the rolling is accompanied by successive polishing operations carried out in the first and each next stand of the rolling mill. It must also be kept in mind that in each stand the rolling is carried out with an optimum microrelief of the billet surface and uniform distribution of the rolling lubricant in the deformation zone.

Preferably, a billet should be worked with coarser microspheres before it enters the first stand of the rolling mill than prior to passing through the other stands.

This ensures optimum rolling conditions according to the percentage reduction in each stand of the rolling mill and helps to improve the mill's performance.

A jet of solid hard spherical bodies is preferably directed at the billet surface before emulsion is supplied to that surface.

This helps to keep the roll surface in good order and prevents adhesion of aluminum to the rolls while rolling sheets of aluminum alloys.

A jet of solid hard spherical bodies may be directed against at least one side of mirror-finished sheet products.

This makes it possible to produce both mirror-finish and dull-finish articles on one rolling mill.

It is advisable that solid hard spherical bodies should be carried by a jet of gas cooled to a temperature of minus 50° C. to minus 200° C., and that billets should be cooled down accordingly.

This makes it possible to improve the mechanical properties of certain grades of steel, while producing mirror-finish products.

A jet of solid hard spherical bodies may act upon the surfaces of aluminum alloy billets.

This is an economical way of producing sheet products of aluminum alloys with a high surface quality which is little dependent upon the quality of the original billets.

It is expedient that a jet of solid hard spherical bodies should be used to act upon the surfaces of billets of stainless steel.

This makes it possible to exclude the operations of etching, grinding and polishing from the process of working sheet billets of stainless steel.

The method of the present invention is best applicable to the manufacture of rolled products of the type which is extensively used in the aircraft industry, radio engineering, nuclear reactors, as well as the refrigerating and food industries.

DESCRIPTION OF THE PREFERRED EMBODIMENTS

Other objects and advantages of the present invention will become more apparent from the following examples illustrating preferred embodiments of the method for manufacturing sheet rolled products with a mirror and/or dull finish, in accordance with the invention.

EXAMPLE 1

A hot-rolled coil of chromium-nickel steel is entered in a four-stand reversing cold mill.

Prior to entering the deformation zone of the first stand, the sheet is worked on both sides with solid hard spherical bodies further referred to as hard microbodies.

In the case under review use is made of hard microbodies of a chrome-nickel alloy. The microbodies are 150 microns in diameter, accelerated to a speed of 120 m/sec. The hard microbodies are supplied intermittently in a pulse-like manner at a rate of 10 pulses per second. The rolling speed is 3 m/sec. The weight concentration of solid hard microbodies in the flow of compressed air is 0.2. The jet of solid microbodies is directed at the surfaces of the rolls of the mill's first stand prior to supplying emulsion to the rolls, in which case, too, use is made of solid hard microbodies 150 microns in diameter, continuously supplied at a rate of 60 m/sec. The weight concentration of solid hard microbodies in the compressed air flow directed at the surfaces of the rolls is 0.1.

In order to rule out penetration of solid hard microbodies in the deformation zone, the surface of the work roll is continuously blown with a flow of compressed air.

Solid hard microbodies are directed at the work roll surface at an angle of 60°.

In the first stand, the reduction amounts to 15.7 percent.

The billet and the working surfaces of the rolls are further acted upon by solid hard microbodies in the fourth stand. This takes place before the billet reaches the zone of deformation. In this case the solid hard microbodies are of glass and have a diameter of 80 microns. Their weight concentration in the flow of compressed air is 0.4. The microbodies are accelerated to a speed of 60 m/sec and directed at the working surface of the rolls at an angle of 15°. The reduction in the fourth stand is 5.6 percent.

In all the stands, solid hard microbodies are directed at the sheet surface at an angle of 70°. Upon leaving the last stand, the sheet has a mirror surface and is sent for cutting and packing.

To produce a dull finish on the rolled sheet, the latter is acted upon by a jet of solid hard microbodies; the working conditions in this case are like those when the sheet is about to enter the fourth stand.

EXAMPLE 2

A hot-rolled coil of an aluminum alloy is entered in a cold-rolling mill. Before the sheet enters the deformation zone of the first stand, it is worked on both sides with solid hard microbodies of glass.

The microbodies are 100 microns in diameter and are accelerated to a speed of 80 m/sec with the rolling speed being 1 m/sec. The weight concentration of solid hard microbodies in the flow of compressed air is 0.3.

In the first stand, a jet of solid hard microbodies is directed at the working surfaces of the rolls, which is done prior to supplying emulsion to the rolls. In this case the material and size of the solid hard microbodies and the working conditions are like those when the sheet is about to enter the first stand.

Microbodies are directed at an angle of 60° to the surfaces of the rolls. The reduction in the first stand amounts to 22 percent.

The sheet and the working surfaces of the rolls are then again acted upon by microbodies of glass, which is done before the sheet enters the zone of deformation of the second stand. In this case the glass microbodies are 70 microns in diameter.

The weight concentration of microbodies in the compressed air flow is 0.4, and their speed is 45 m/sec. The jet of solid hard microbodies is directed at the working surfaces of the rolls at an angle of 15°. The reduction in the second stand is 9 percent.

In both stands, solid hard microbodies are directed at the surfaces of the sheet at an angle of 70°.

As a result, the sheet acquires a polished surface.

The above examples refer to sheets of aluminum alloys and stainless steel, but the method of this invention is fit to produce a mirror finish on rolled products of many other materials, such as titanium, copper and even different grades of carbon steel, for which purpose use is made of solid hard microbodies 40 to 200 microns in diameter.

The mechanical strength and cost of solid hard microbodies may be different, being dependent upon the properties of the material to be worked and surface finish requirements. Solid hard microbodies may be of aluminum oxide, chrome-nickel alloys, zirconium oxide, glass and even ice. Sheets of carbon steel are preferably worked with microbodies of ice or aluminum oxide with an addition of harder microbodies of chrome-nickel alloys. The use of cheaper materials helps to reduce the working costs. Sheet products of carbon steel are normally rolled at higher speeds than products of other materials, wherefore it is advisable that the speed of solid hard microbodies should be increased from 20 m/sec to 300 m/sec.

In order to improve the mechanical properties of certain grades of steel, the rolling is carried out at subzero temperatures of minus 50° C. to minus 200° C. In order to produce a mirror finish on such steels, the gas, such as compressed air, nitrogen, etc., should also be cooled to a temperature of minus 50° C. to minus 200° C. This makes it possible to combine the operations of preparing the microrelief of the sheet for rolling, the cleaning of the sheet surface and partial cooling of the sheet. In cases of rolling thin sheet (less than 1 mm thick), the cooling is complete.

The quality of finish is improved by tempering rolled sheet products on a temper mill. The sheet to be worked on the temper mill has a dull finish, coming out of the cold-rolling mill after having been worked with a jet of solid hard microbodies as it leaves the last stand of the mill.

Sheets may be worked with solid hard microbodies right on the temper mill, prior to the tempering operation, in which case it is advisable that use should be made of microbodies 40 to 80 microns in diameter.

The method according to the invention was tested for rolling 6.2-millimeter sheet of an aluminum alloy on a taper mill. The sheet itself had been produced on a hot-rolling mill.

Prior to entering to rolling mill stand, the sheet was worked with a jet of glass microbodies 60 microns in diameter. The weight concentration of microbodies in the flow of compressed air was 0.4. The speed at which microbodies were directed at the sheet surface was 70 m/sec.

The rolling was done in two passes with a reduction of 11 percent and with the use of 3-percent oil-in-water type coolant. As a result, the aluminum sheet was given a mirror finish. No pure oil was used in the process, which accounted for a reduced cost of rolling.

What is claimed is:

1. Method of providing mirror and dull finishes, without etching, grinding or polishing, on the surfaces of rolled sheet metal products obtained by subjecting sheet metal billets to a plurality of reverse rolling operations in a rolling mill, wherein each roll operation includes rolling the sheet metal billets in a plurality of stands in said rolling mill with application of cooling emulsion to the sheet metal billets prior to each rolling step in each mill stand, which comprises directing a jet of a gas carrying solid hard spherical bodies of a material selected from the group consisting of glass, aluminum oxide, zirconium oxide, chrome-nickel alloys and ice of 40–200 microns diameter onto the surface of a hot sheet metal billet prior to each rolling step in each mill stand in each reverse rolling operation and prior to each application of the cooling emulsion to the sheet metal billet, and rolling the thus treated billet after each such treatment onto a stand of the rolling mill, whereby the surface obtains the desired finish.

2. A method as claimed in claim 1, wherein use is made of a combination of solid hard spherical bodies of different chemical composition.

3. A method as claimed in claim 1, wherein solid hard spherical bodies of different chemical composition are used in succession.

4. A method as claimed in claim 1, wherein said solid hard spherical bodies are directed at the surface of said sheet metal billet at a speed of 20 m/sec to 300 m/sec.

5. A method as claimed in claim 1, wherein the solid hard spherical bodies are used in a weight concentration of bodies in the carrying gas of 0.05–0.5 parts by weight bodies per part by weight gas.

6. A method as claimed in claim 1, wherein said solid hard spherical bodies are used to work at least one side of a rolled sheet to a mirror finish.

7. A method as claimed in claim 1, wherein the gas carrying said solid hard spherical bodies is cooled to a temperature of minus 50° C. to minus 200° C., so as to cool said sheet metal billet while the surface thereof is being treated.

* * * * *